US005241294A

United States Patent [19]

Pham et al.

[11] Patent Number: 5,241,294

[45] Date of Patent: Aug. 31, 1993

[54] VARISTOR AND RESISTOR DEVICE FOR THE INTERRUPTING CHAMBER OF CIRCUIT BREAKER

[75] Inventors: Van Doan Pham, Meyzieu; Deville Robert, Lyons; Martin Joseph, Meyzieu, all of France

[73] Assignee: GEC Alsthom SA, Paris, France

[21] Appl. No.: 846,610

[22] Filed: Mar. 5, 1992

[30] Foreign Application Priority Data

Mar. 13, 1991 [FR] France ..... 91 03034

[51] Int. Cl.[5] ..... H01C 7/10

[52] U.S. Cl. ..... 338/21; 200/144 AP; 361/127

[58] Field of Search ..... 338/20, 21; 361/111, 361/117, 118, 127, 128, 40, 126, 124, 56; 200/144 AP, 146 R, 147 R, 148 A, 148 R

[56] References Cited

U.S. PATENT DOCUMENTS 1,873,499 8/1932 Steinmayer ..... 361/124
2,890,383 6/1959 Olsen ..... 338/20
4,363,017 12/1982 Weniger ..... 338/21

FOREIGN PATENT DOCUMENTS 0117914 9/1984 European Pat. Off. .
1218582 6/1966 Fed. Rep. of Germany .

*Primary Examiner*—Marvin M. Lateef
*Attorney, Agent, or Firm*—Sughrue, Mion, Zinn, Macpeak & Seas

[57] ABSTRACT

A varistor and resistor device for incorporating in the interrupting chamber of a dielectric gas circuit breaker, the varistor and resistor components being connected in series and being housed in an insulating tube. The varistor components and the resistor components are firstly superposed with superposed components being separated from one another by insulating components, and are secondly juxtaposed with juxtaposed components being electrically interconnected by conductor components interposed between the ends of the superposed components and the insulating components.

7 Claims, 4 Drawing Sheets

VARISTOR AND RESISTOR DEVICE FOR THE INTERRUPTING CHAMBER OF CIRCUIT BREAKER

The present invention relates to a varistor and resistor device for incorporation in the interrupting chamber of a dielectric gas circuit breaker, with the varistor and resistor components being connected in series and housed in an insulating tube.

BACKGROUND OF THE INVENTION

French patent No. 90 07425 filed by the common corporate assignee (published under No. 2 663 456 and corresponding to U.S. Ser. No. 692,421 now U.S. Pat. No. 5,164,559) relates to a circuit breaker with incorporated varistance, and including a device for inserting the varistance while the circuit breaker is opening. In that device, the varistor is constituted by a stack of pellets preferably made of metal oxides based on zinc oxide. The pellets form a cylindrical column coaxial with the casing of the circuit breaker. Resistive pellets may be connected in series therewith by extending the stack. They serve to limit power in the varistor components. The entire stack is housed inside a non-sealed insulating tube.

A single stack of varistor and resistor pellets occupies a considerable vertical height and requires the circuit breaker to be extended upwards.

The object of the present invention is to make the varistor and resistor device more compact by significantly reducing its height.

SUMMARY OF THE INVENTION

For this purpose, according to the present invention, the varistor components and the resistor components are firstly superposed, with superposed components being separated from one another by insulating components, and they are secondly juxtaposed with juxtaposed components being electrically interconnected by conductor components interposed between the ends of the superposed components and the insulating components.

In a first variant, each varistor component is constituted by at least one annular varistor and each resistor component is constituted by at least one cylindrical resistor, the annular varistor components being of the same size and being stacked on one another, and the cylindrical resistor components being of the same size and being stacked above one another inside the orifice within the stack of annular varistors.

In that disposition, the varistor components are preferably separated by insulating rings and the resistor components by insulating cylinders.

In a preferred embodiment of the invention, each cylindrical resistor component is inserted electrically in series between adjacent annular varistor components, the electrical connection being provided by a metal disk of diameter substantially equal to the diameter of the annular varistors and having a circular cup in the middle thereof of diameter substantially equal to the diameter of the cylindrical resistors.

In a second variant, each varistor component is constituted by at least one cylindrical varistor and each resistor component is constituted by at least one cylindrical resistor having the same diameter, said components being stacked in two adjacent stacks, the resistor components being inserted in regular manner.

In that disposition, the components are preferably separated by insulating disks.

In a preferred embodiment thereof, each conductor component is constituted by a metal blade having two circular disks of diameter substantially equal to the diameter of the cylindrical components and interconnected by a bent tongue.

Finally, the cylindrical components have the same height, with the components of one of the stacks being regularly offset in height relative to the components in the other stack.

In a third variant, some of the varistor and resistor components are built up into stacks comprising at least one cylindrical resistor R and at least one cylindrical varistor V of the same diameter while others constitute at least one cylindrical varistor V identical to the above-mentioned varistor, said components being stacked in three stacks that are adjacent and equidistant.

In that disposition, the superposed components are separated by insulating components in the form of disks of thickness e, each including a circular orifice and a positioning surface comprising two interconnected circular cups, the cups and the orifices being slightly greater in diameter than the varistor components and the resistor components, and said insulating components are disposed one above the other and are offset at 120° relative to one another.

Under such circumstances, each conductor component is preferably constituted by a metal blade comprising two disks of diameter substantially equal to the diameter of the cylindrical components and interconnected by a tongue.

Finally, in a preferred embodiment of the invention, the height of the resistors R is substantially equal to the height of the varistors V plus the thickness e of an insulating component and the thickness of two conductive components.

According to another feature of the invention, effective protection against polluted gas is provided for the varistor and resistor components. In the known arrangement, these components are in direct contact with the circuit-breaking gas (generally $SF_6$) in the interrupting chamber.

To avoid the detrimental consequences of the decomposition products of $SF_6$, the side surfaces of the pellets are often protected by a special coating. This protection is improved by the fact that the insulating tube receiving the varistor components and the resistor components has a molecular sieve cartridge at one of its ends, the support pieces for said sieve including channels for passing the interrupting gas through the tube via the sieve.

To reduce surges effectively, the varistor is designed to limit a transient voltage to about 1 p.u. This condition requires the resistor to have a certain resistance in order to obtain a discharge current through the device which is acceptable both thermally and dielectrically prior to the current being interrupted by the insertion device.

Particularly when circuit breaking in phase opposition, the resistance per interrupting chamber is fixed in the range 200 ohms to 800 ohms. With such a resistance, the current can be limited to a few hundred amps.

In addition, the use of a resistor having a slightly positive temperature coefficient also makes it possible to reduce energy when circuit breaking in phase opposition, particularly after the second current alternation and before the current is finally interrupted by the insertion device. The resistor is then designed so as to double its initial resistance, for example, after the second current alternation when circuit breaking in phase opposition.

Under other circuit breaking conditions (unloaded line, short circuit), interruption takes place practically on one alternation. This makes it possible for the resistance to increase relatively little, thereby discharging the line more quickly. The initial resistance may be chosen to lie in the range 100 ohms to 400 ohms.

BRIEF DESCRIPTION OF THE DRAWINGS

The invention is described in greater detail with reference to the drawings that show preferred embodiments only.

MORE DETAILED DESCRIPTION

Figure 1:
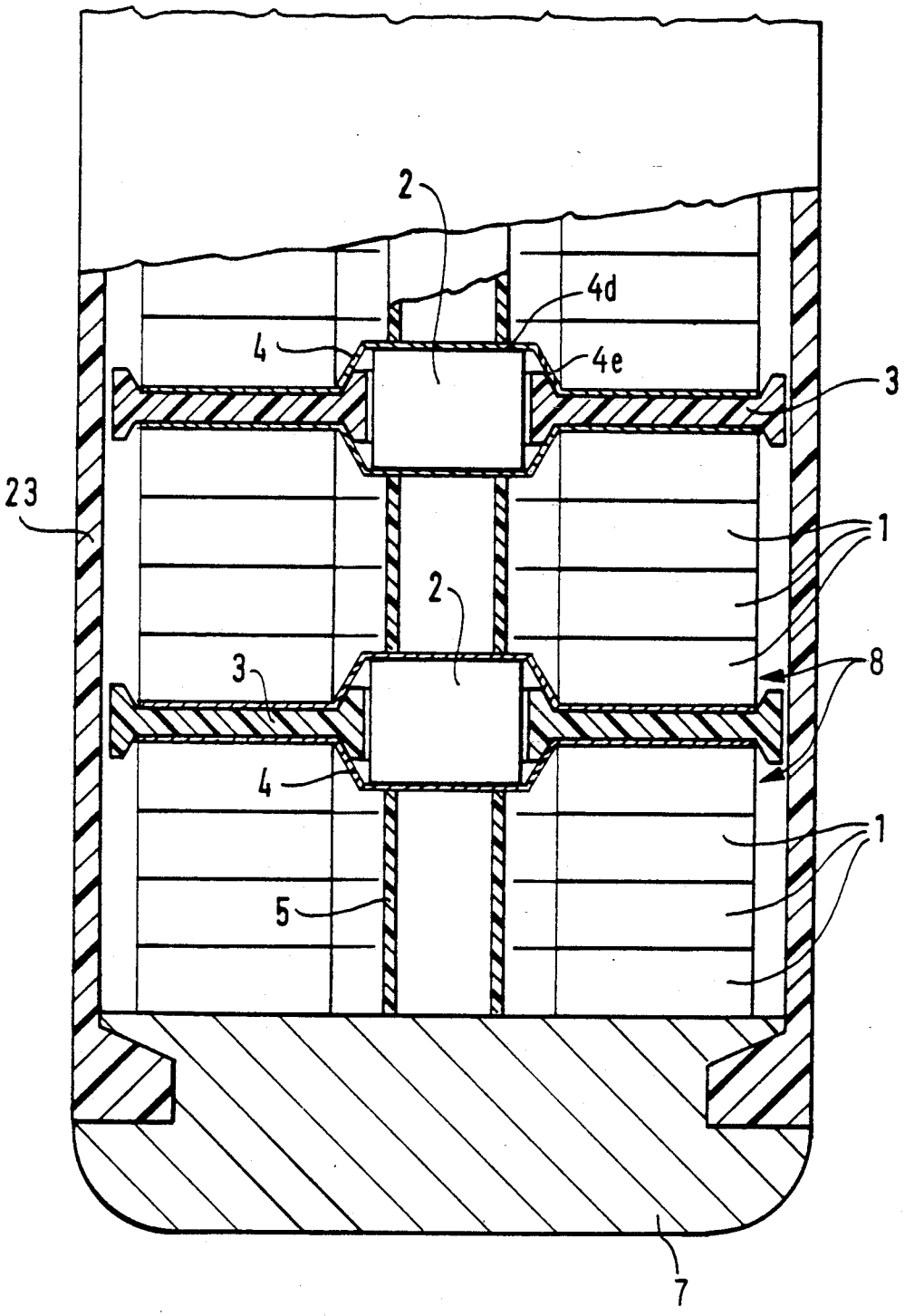
FIG. 1 is a longitudinal section view through a first embodiment of a varistor and resistor device in accordance with the invention.

FIG. 1 shows a first embodiment of the invention.

Varistors 1 are annular in shape and are stacked in sets of four varistors in this embodiment. The resistors 2 which are preferably cylindrical in shape, are inserted in series between such sets.

The resistors 2 are installed in the central orifice formed by the annular varistors 1.

Blocks 8 of plural stacked varistors 1 are separated by insulating disks 3 that are annular in shape and slightly larger in size than the varistors 1 so as to form positioning surfaces therefor.

The resistors 2 are disposed in the orifices of these insulating disks 3 and they are connected to the two adjacent blocks of varistors 1 by respective metal conducting disks 4 having an outside diameter substantially equal to the outside diameter of the varistors, and including respective circular cups in their middles. Thus, a resistor 2 is received between two conductive disks 4, making contact with the bases 4*d* of their cups 4*e* and with the disks being separated by an insulating disk 3.

The resistors 2 are supported by and mutually separated by preferably tubular cylinders 5 of insulating material.

The entire assembly is disposed inside an insulating tube 23. The electrical inlet and outlet thereof, at 7 are made as described in French patent Document 2 663 456.

The total stack length made up by the resistor components is less than that made up by the varistors components, for example in a ratio of 1/2, 1/3, or 1/4 depending on the required operating conditions.

Figure 2:
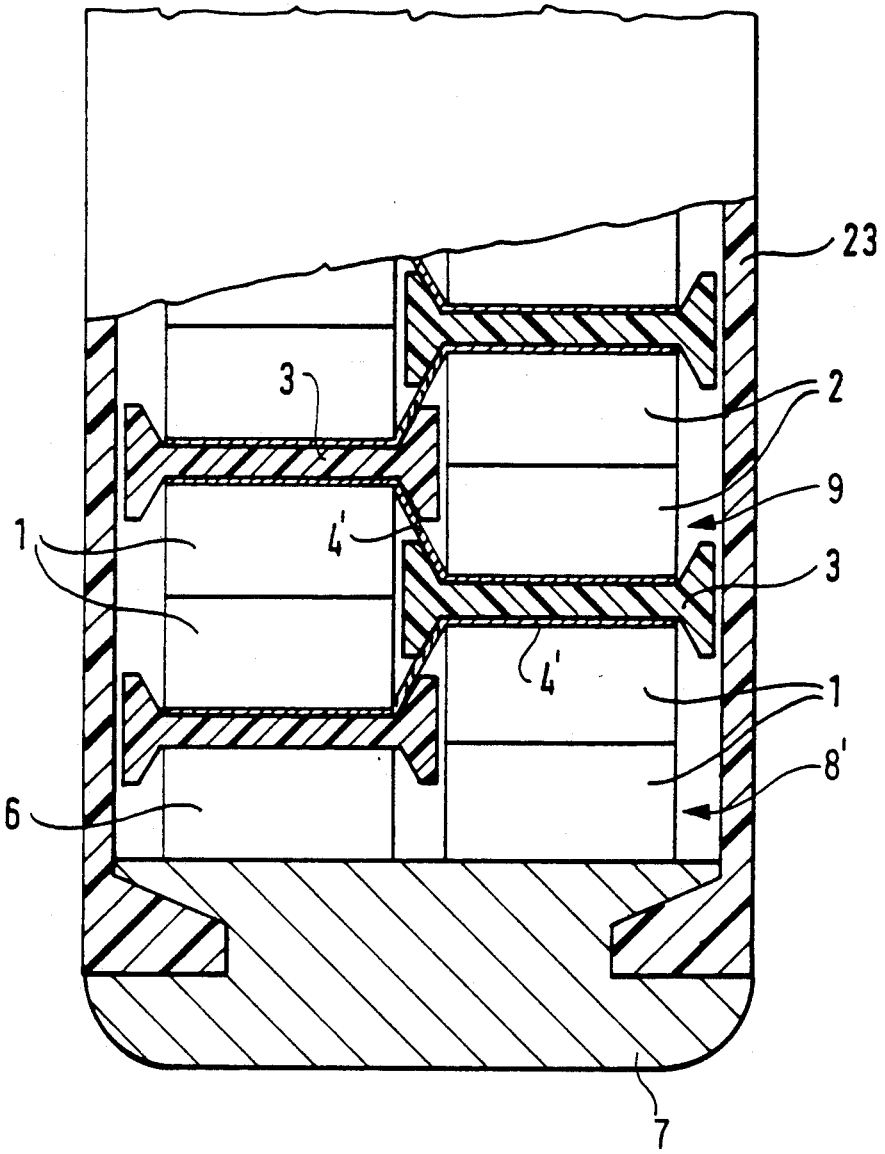
FIG. 2 is a longitudinal section view through a second embodiment of a varistor and resistor device in accordance with the invention.

FIG. 2 shows a second embodiment of the invention.

In this case, the varistors 1 are in the form of solid cylinders. The resistors 2 are preferably of the same form and of the same size.

In the example shown, each set of resistors or varistors forming respective blocks 81 and 9 is constituted by two cylindrical components. The varistors 1 and the resistors 2 are thus disposed in stacked sets which are separated by circular disks 3 of slightly larger diameter than the resistors or the varistors so as to form positioning surfaces therefor.

The blocks of varistors 1 or of resistors 2 are disposed in two adjacent stacks. The blocks are preferably offset in a regular manner so as to enable identical conductor components 4 to be used up the entire height of the stacks.

Figure 3:
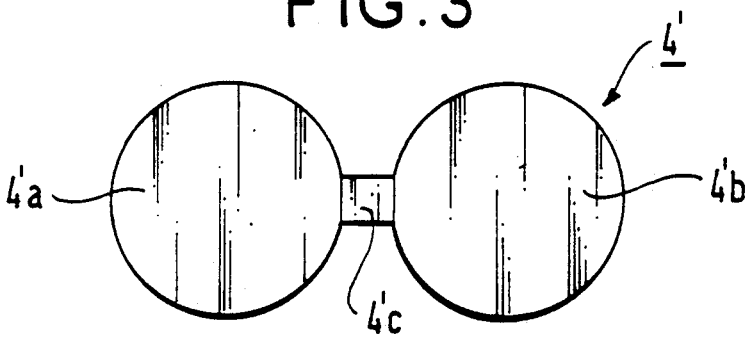
FIG. 3 is a plan view of a conductor component used in the second embodiment of the device.

These conductor components 4' (see also FIG. 3) are made of sheet metal and each of them comprises two circular disks 4'*a*, 4'*b* having the same diameter as the varistors and the resistors, and interconnected by a respective bent tongue 4'*c*. The disks 4'*a* and 4'*b* are interposed between the blocks and the insulating disks 3 so as to establish an electrical series connection between blocks that are side by side.

In order to provide simple inlet and outlet connections at the ends of the stacks, as described in Document No. FR-A-2 663 456 spacer 6 of any appropriate material and of half the height of each block is installed at the end of one or other of the stacks. The assembly is housed in an insulating tube 23.

Figure 4:
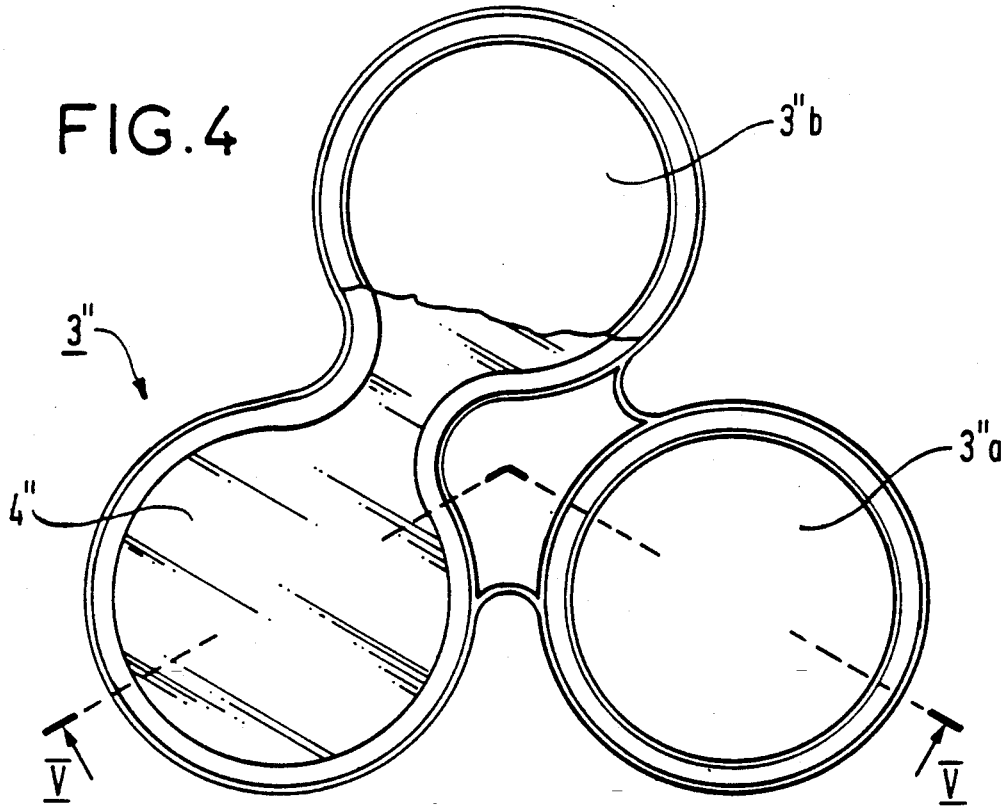
FIG. 4 is a plan view of an insulator component used in the third embodiment of the device.
Figure 5:
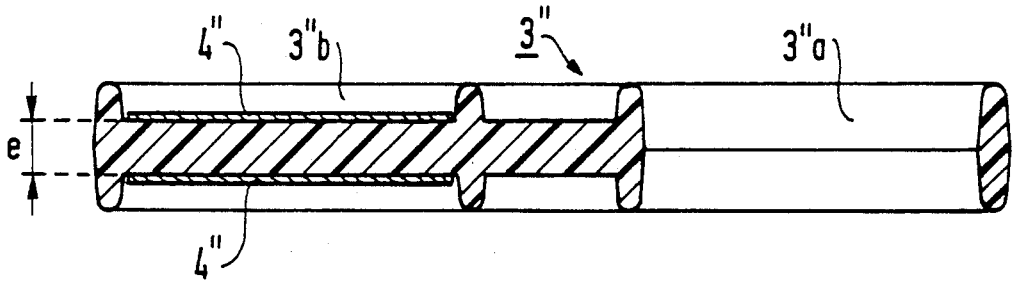
FIG. 5 is a section on V—V of said insulator component.
Figure 6:
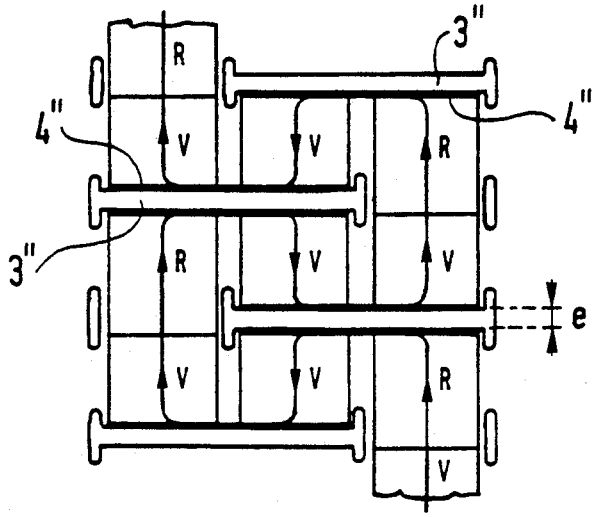
FIG. 6 is a deployed view of another embodiment of the device.

FIGS. 4, 5, and 6 show a third embodiment with varistors and resistors connected in series. These components are cylindrical in shape and they are stacked in three adjacent and equidistant stacks.

The insulating disks 3" are shown in FIGS. 4 and 5. In the example shown, they are generally triangular in plan shape comprising a circular orifice 3"*a* and a positioning surface 3"*b* for receiving a conductor component 4" in the form of two circular disks interconnected by a tongue.

FIG. 6 constitutes a deployed view of the resistor and varistor device that makes use of such disks.

The varistors V are all of the same height and the resistors R are all of the same height equal to that of the varistors V plus a thickness e of an insulating disk and the thickness of two conducting blades 4". The conductor component 4 is preferably made of sheet metal and its relative flexibility serves to take up any play.

The disks 3 are disposed one above another and they are offset at 120° relative to one another. A series connection is thus established comprising a varistor plus a resistor V+R, a varistor V, a varistor plus a resistor, V+R, a varistor R, etc. FIG. 6.

This disposition requires an insulating tube 23 of larger diameter than in the above-described embodiments. It is therefore entirely suitable for circuit breakers having a grounded body, e.g. of the metal-clad type. In contrast, the height of the tube 23 is greatly reduced.

Figure 7:
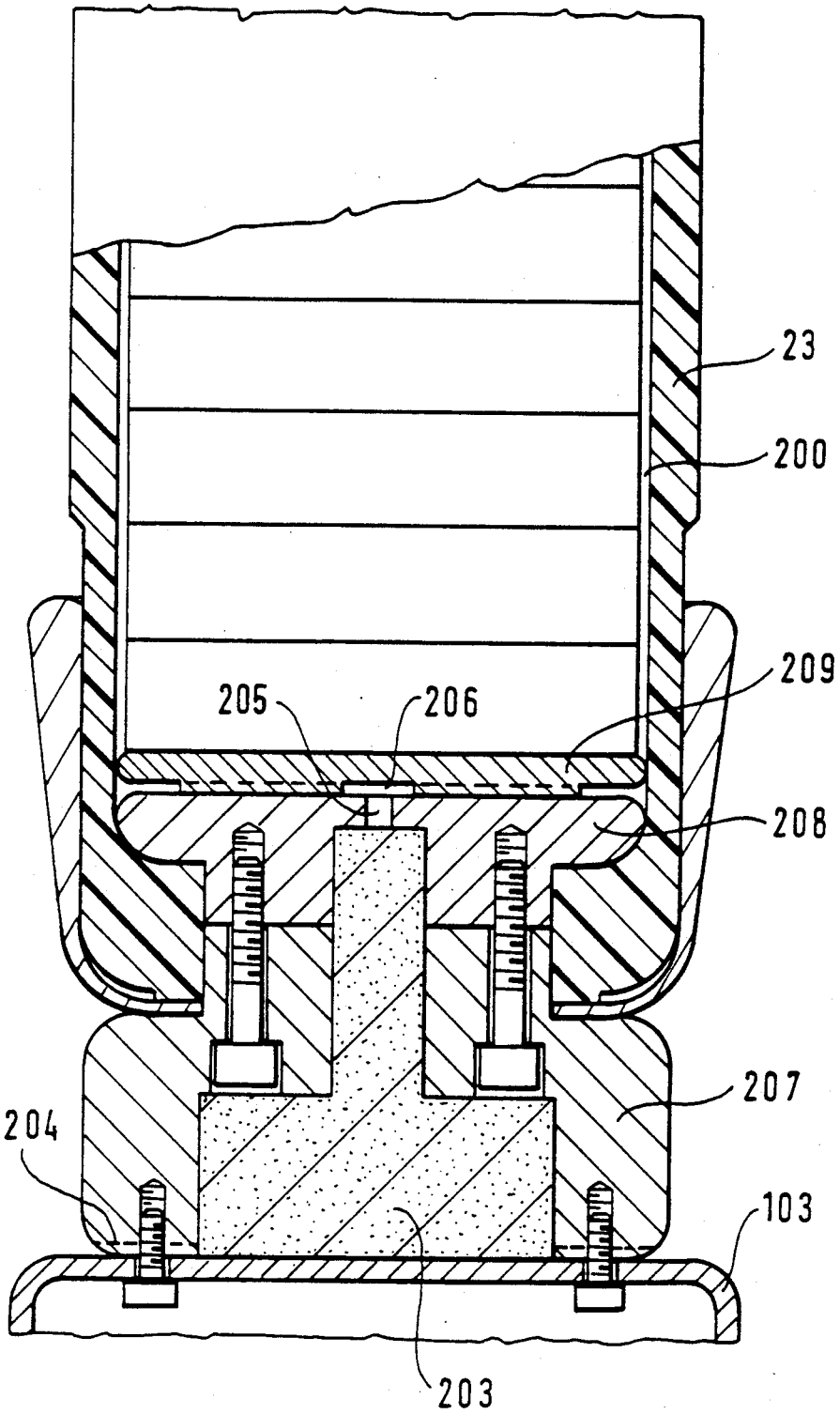
FIG. 7 is a longitudinal section view through the device in accordance with the invention, showing more particularly the sealing arrangement against pollution from the interrupting gas.

FIG. 7 shows a characteristic of the device in accordance with the invention concerning the organization of the bottom end thereof.

In this figure, varistors and resistors are represented diagrammatically by a single stack.

To prevent the circuit breaking gas entering directly into the inside space 200 of the tube 23 from the space inside the circuit breaker, a piece 207 is bolted onto a co-operating disk 208. These two pieces receive the cartridge 203 of a molecular sieve and including channels or grooves 204 and 205. The gas is thus constrained to enter via the grooves 204 passing through the cartridge 203 into the channel 205 and then through the grooves 206 of a plate 209 before penetrating into the space 200.

The molecular sieve contained in the cartridge 203 having a perforated surface serves to absorb the decomposition products of $SF_6$ due to the circuit-breaking arc and to moisture contained either in the gas or else in the solid components (tube 23, varistors 1, resistors 2, . . . ).

The channel 205 enables pressure to be balanced between the space 200 and the space inside the circuit breaker after circuit-breaking operations have been performed.

Because of the arrangement described, a cartridge 203 can be installed very quickly, at the last minute immediately before installing the insertion arm 103 of the varistor and resistor device.

We claim:

1. A varistor and resistor device for incorporation in an interrupting chamber of a dielectric gas circuit breaker, said device comprising a plurality of varistor and resistor components connected in series and housed in an insulating tube, wherein the varistor components and the resistor components are firstly superposed, wherein said superposed varistor components are separated from the resistor components by insulating components, wherein said varistor components are secondly, laterally juxtaposed to said resistor components, and wherein laterally juxtaposed components are electrically interconnected by conductor components interposed between the ends of the superposed varistor and resistor components and said insulating components, wherein each varistor component is constituted by at least one annular varistor and each resistor component is constituted by at least one cylindrical resistor, the annular varistor components being of the same size and being stacked on one another, and the cylindrical resistor components being of the same size and being stacked above one another inside an orifice of a stack of annular varistors, wherein the varistor components are separated by insulating rings and the resistor components are separated by insulating cylinders, and said insulating rings and said insulating cylinders constitute said insulating components, and wherein each cylindrical resistor component is inserted electrically in series between adjacent annular varistor components, the electrical connection being provided by a metal disk constituting one of said conductor components of a diameter substantially equal to the diameter of the annular varistors and having a circular cup in the middle thereof of diameter substantially equal to the diameter of the cylindrical resistors, and said cup has a base in direct contact with a face of said each cylindrical resistor.

2. A device according to claim 1, wherein the insulating tube receiving the varistor components and the resistor components further including a molecular sieve cartridge at one end thereof and a support piece for said sieve including channels for passing interrupting gas through the tube via the sieve.

3. A device according to claim 1, wherein the resistance of the resistor components connected in series with the varistor components within an interrupting chamber lies in the range of 200 ohms to 800 ohms, with the varistance per phase of said varistor components being chosen to limit transient voltage to 1 p.u.

4. A device according to claim 1, wherein the resistor components connected in series with the varistor components have a small positive temperature coefficient.

5. A varistor and resistor device for incorporation in an interrupting chamber of a dielectric gas circuit breaker, said device comprising a plurality of varistor and resistor components connected in series and housed in an insulating tube, wherein the varistor components and the resistor components are firstly superposed, wherein said superposed varistor components are separated from the resistor components by insulating components, wherein said varistor components are secondly, laterally juxtaposed to said resistor components, and wherein laterally juxtaposed components are electrically interconnected by conductor components interposed between the ends of the superposed varistor and resistor components and said insulating components, wherein each varistor component is constituted by at least one cylindrical varistor and each resistor component is constituted by at least one cylindrical resistor having the same diameter as that of each resistor, said components being stacked in two laterally adjacent stacks, the resistor components being inserted between varistor components in said two adjacent stacks in a regular alternating manner, wherein the resistor components are separated from the varistor components by insulating disks constituting said insulating components, and wherein each conductor component is constituted by a metal blade having two circular disks of diameter substantially equal to the diameter of the cylindrical varistor and resistor components and interconnected by a bent tongue.

6. A device according to claim 5, wherein the cylindrical varistor and resistor components have the same height, with the varistor and resistor components of one of the stacks being regularly offset in height relative to the varistor and resistor components in the other stack.

7. A varistor and resistor device for incorporation in an interrupting chamber of a dielectric gas circuit breaker, said device comprising a plurality of varistor and resistor components connected in series and housed in an insulating tube, wherein the varistor components and the resistor components are firstly superposed, wherein said superposed varistor components are separated from the resistor components by insulating components, wherein said varistor components are secondly, laterally juxtaposed to said resistor components, and wherein laterally juxtaposed components are electrically interconnected by conductor components interposed between the ends of the superposed varistor and resistor components and said insulating components, wherein some of the varistor and resistor components are built up into stacks comprising at least one cylindrical resistor R and at least one cylindrical varistor V of the same diameter while others of the varistor and resistor components constitute at least one cylindrical varistor V identical to the above-mentioned varistor, said varistor and resistor components being stacked in three stacks that are adjacent and laterally equidistant from each other, wherein the superposed varistor and resistor components are separated by respective insulating components in the form of disks of thickness e, each including a circular orifice and a positioning surface comprising two interconnected circular cups, the cups and the orifices being slightly greater in diameter than the varistor components and the resistor components, and wherein said insulating components are disposed one above the other and are offset at 120° circumferentially relative to one another, wherein each conductor component is constituted by a metal blade comprising two disks of diameter substantially equal to the diameter of the cylindrical varistor and resistor components and interconnected by a tongue, and wherein the height of resistors R thereof is substantially equal to the height of varistors V thereof plus the thickness e of an insulating component and the thickness of two conductive components.

* * * * *